United States Patent [19]

Haire et al.

[11] Patent Number: 4,877,513

[45] Date of Patent: Oct. 31, 1989

[54] OIL CHARACTERISTIC IMPROVEMENT PROCESS AND DEVICE THEREFOR

[75] Inventors: William M. Haire, Huntington Beach; Celestino Pou, Diamond Bar, both of Calif.

[73] Assignee: Hydrocarbon Sciences, Inc., Bakersfield, Calif.

[21] Appl. No.: 131,944

[22] Filed: Dec. 11, 1987

[51] Int. Cl.[4] ..... C10G 9/14

[52] U.S. Cl. ..... 208/106; 208/125; 208/132; 208/291; 208/294; 208/295

[58] Field of Search ..... 208/106, 125, 124, 132, 208/177, 180, 136, 240, 291, 294, 295

[56] References Cited

U.S. PATENT DOCUMENTS

| | | | |
|---|---|---|---|
| 2,412,983 | 12/1946 | Hene | 208/125 |
| 2,767,123 | 10/1956 | Hickok et al. | 208/295 |
| 3,097,156 | 7/1963 | Johnson et al. | 208/124 |
| 3,235,484 | 2/1966 | Colfer | 208/125 |
| 3,696,166 | 10/1972 | Ozawa et al. | 208/125 |
| 3,846,288 | 11/1974 | Chun et al. | 208/295 |
| 3,865,715 | 2/1975 | Nametkin et al. | 208/244 |
| 4,046,670 | 9/1977 | Seguchi et al. | 208/121 |
| 4,298,460 | 11/1981 | Fujimori et al. | 208/124 |
| 4,334,920 | 6/1982 | Mori et al. | 208/121 |
| 4,379,745 | 4/1983 | Polizzoti et al. | 208/132 |
| 4,430,204 | 2/1984 | Aiello et al. | 208/291 |
| 4,600,502 | 7/1986 | Butler et al. | 208/291 |
| 4,604,188 | 8/1986 | Yan et al. | 208/125 |
| 4,748,289 | 5/1988 | Douglass | 585/14 |

*Primary Examiner*—Anthony McFarlane

*Attorney, Agent, or Firm*—Spensley Horn Jubas & Lubitz

[57] ABSTRACT

An oil characteristic improvement process and device therefor including methodology whereby the specific gravity and viscosity of heavy oil feedstock is reduced. The process includes the steps of forming a mixture of the heavy oil feedstock and one or more organic reagents having a terminal hydroxyl group and heating the mixture from 300° F. to 750° F. in a reactor vessel while simultaneously exposing the mixture to a ferrous metal. In connection with this process, the present invention is also directed to a tubular reactor vessel, the inner walls of which include ferrous metal, the inner diameter and length of the tubular vessel being chosen such that the flow rate of the heavy oil through the vessel is such that the residence time within the vessel ranges from 600 to 6000 seconds, the heat flux through the walls of the vessel is less than 20,000 BTU/hr/sq.ft., and wherein the heavy oil flowing through the operative portion of the reactor vessel is never in the spray flow regime when the inner wall of the vessel is at a temperature greater than 750° F.

28 Claims, 2 Drawing Sheets

OIL CHARACTERISTIC IMPROVEMENT PROCESS AND DEVICE THEREFOR

BACKGROUND OF THE INVENTION

1. Field of the Invention

This invention relates to processes intended to modify the characteristics of hydrocarbons of high molecular weight such as are found in heavy oils. In particular, the present invention relates to processes intended to reduce the viscosity and specific gravity of heavy oil. Specifically, the present invention is related to processes intended to increase the volume of light hydrocarbons distilled from a heavy oil feedstock at a selected temperature.

2. Background of Related Art

Crude oil is a non-uniform, highly complex mixture of hydrocarbon compounds (combinations of carbon and hydrogen atoms) with varying amounts of sulphur, nitrogen, oxygen, and other impurities. The composition of crude oils can vary considerably, even in nearby oilfields. For example, crude oil adjacent the Kern river in Kern County, Calif., U.S.A., has an API gravity of 12.6, a sulphur content (in percent by weight) of 1.19, a specific gravity of 0.982, and a viscosity (SSU at 100° F.) of 6000 seconds; all at a depth of 1,099 to 1,183 feet. Alternatively, crude oil adjacent Greeley in Kern County, Calif., U.S.A., has an API gravity of 37.2, a sulphur content (in percent by weight) of 0.31, a specific gravity of 0.839, and a viscosity of 41 seconds; all at a depth of 11,260 feet to 11,500 feet.

From a non-technical viewpoint, heavy oil can be described as crude oil with a consistency similar to that of cold molasses. However, a technical description indicates that heavy crude oil has a lower hydrogen-to-carbon ratio than lighter crude oil. Because carbon atoms are about twelve times heavier than hydrogen atoms, the density (weight per unit volume) of heavy crude oil is greater than that of lighter crude oil—hence the name, heavy oil.

High specific gravity (which is related to density) and viscosity are properties of heavy oil that cause major production and handling problems. Viscosity is the resistance of fluid to flow.

Although there was no precise definition of heavy crude oil in the past, the definition adopted by the U.S. Department of Energy for its former pricing regulations (and the definition most often used by the petroleum industry) was any crude oil with an API gravity of 20° or less.

Recently, a more precise definition has been adopted. Heavy oil is any crude oil with an API gravity ranging from 10° to 20° (inclusive) at standard conditions and with a gas-free viscosity ranging from 100 to 10,000 centipoises (inclusive) at original reservoir temperature. Tar sand oil, also known as bitumen or ultra heavy oil, is any crude oil with an API gravity less than 10° and a gas-free viscosity greater than 10,000 centipoises.

Crude oil is a mixture of many different chemical components. Each component has its own boiling point; therefore, each component theoretically can be separated from the mixture through distillation. The problem however with heavy oil is the difficulty and expense entailed in increasing the volume of light hydrocarbons distilled from a heavy oil feedstock. Typically, this is done by increasing the hydrogen-to-carbon ratio. This can be accomplished by either removing carbon or by adding hydrogen. Carbon is typically removed by coking, solvent deasphalting, or catalytic cracking. Hydrogen is typically added by hydrotreating or hydrocracking. Other refining processes are discussed in Leffler, William L., "Petroleum Refining for the Nontechnical Person", Tulsa, Okla., Petroleum Publishing Company (1979) and Nelson, W.L., "Petroleum Refinery Engineering", New York, McGraw-Hill, pp. 75–77 (1969).

Hydrocracking processes are known which utilize a catalyst in a hydrogen environment to convert heavy distillates into lighter distillates such as gasoline or jet fuels. As discussed further below, such processes typically include adding to the heavy oil feedstock or distillate a source of donor hydrogen such as hydrogen gas. Unfortunately, typical heavy-oil feedstocks have relatively high metal content (100 parts per million or higher) thus limiting the application of hydrocracking because the metals contaminate the catalyst.

There are several issued patents related to the field of the present invention.

U.S. Pat. No. 3,830,730 relates to a method for improving the viscosity of hydrocarbon lubricating oil fractions. The method uses a solid-bed absorbant, liquid cyclohexane at 50° to 300° F. as an eluent, a hydrogenation catalyst and hydrogen gas at pressures between 750 and 5,000 psi.

U.S. Pat. No. 4,399,025 relates to a solvent extraction process for re-refining used lubricating oil. This patent involves use of tetrahydrofurfuryl alcohol (THFA) in a solvent extraction operation to remove impurities, the use of sub-atmospheric pressures (10 to 100 mm Hg absolute) and temperatures of about 300° F. in a steam-stripping operation to recover the THFA for recycling.

U.S. Pat. No. 4,434,045 relates to a process for converting petroleum residuals. The process uses gaseous hydrogen at partial pressures ranging from 1500 to 2500 psi and temperatures ranging between 800° and 850° F.

U.S. Pat. No. 4,462,893 relates to a process for producing pitch for use as raw material for carbon fibers. The '893 process uses various organic chemicals for solvent extraction at temperatures ranging from 734° to 842° F.

U.S. Pat. No. 3,968,023 relates to a method of upgrading residual oils using various organic compounds for solvent extraction and hydrogen partial pressures ranging from 800 to 3,000 psi.

U.S. Pat. No. 4,487,687 relates to a method of processing heavy hydrocarbon oils. The method of this patent involves use of coke as a deasphalting agent prior to hydrogenation, the use of recycled oil as a hydrogen donor solvent at approximately a 1:1 weight ratio to the feedstock, and the use of pressures ranging between 60 and 170 atmospheres during hydrogenation.

U.S. Pat. No. 4,292,168 relates to a method of upgrading heavy oils by non-catalytic treatment with hydrogen and a hydrogen-transfer solvent. The method of this patent uses hydrogen-transfer solvents at a weight ratio ranging from 0.2 to 3.0 of the feedstock weight, temperatures ranging from 608° to 932° F. and pressures ranging from 20 to 180 atmospheres.

U.S. Pat. No. 3,083,155 relates to the use of steel enclosures having a hydrogen partial pressure of 100–700 lbs/square inch and temperatures of 550° to 1100° F.

Notwithstanding the disclosures in the above patents, there is a continuing need for an efficient process for reducing the specific gravity and viscosity of heavy oil. There is a further need for a process for increasing the volume of light hydrocarbons distilled from a heavy oil feedstock at a selected temperature. There is a need for a process to accomplish these objectives which operates (1) at low pressures (near atmospheric pressure), (2) without an external hydrogen gas supply, (3) without being dependent upon a solvent extraction process, and (4) which utilizes a small amount of an active reagent.

SUMMARY OF THE INVENTION

The present invention fulfills the above-referenced needs and provides an efficient process for reducing the specific gravity and viscosity of heavy oil. The process of the present invention increases the volume of light hydrocarbons distilled from a heavy oil feedstock at a selected temperature. The process of the present invention operates at low pressures (near atmospheric pressure), without an external hydrogen gas supply, and without being dependent upon a solvent extraction process. Moreover, the present utilizes an active reagent which is less than 3% by weight of the heavy oil feedstock.

Specifically, the present invention is directed to a process for reducing the specific gravity and viscosity of a heavy oil feedstock including the steps of forming a mixture of the heavy oil feedstock and one or more reagents having a terminal hydroxyl group and heating the mixture from 300° F. to 750° F. in a reactor vessel while simultaneously exposing the mixture to a ferrous metal. In connection with this process, the present invention is also directed to a tubular reactor vessel, the inner walls of which include ferrous metal, the inner diameter and length of the tubular vessel being chosen such that the flow rate of the heavy oil through the vessel is such that the residence time within the vessel ranges from 600 to 6000 seconds, the heat flux through the walls of the vessel is less than 20,000 BTU/hr/sq.ft., and wherein the heavy oil flowing through the operative portion of the reactor vessel is never in the spray flow regime when the inner wall of the vessel is at a temperature greater than 750° F.

DETAILED DESCRIPTION OF THE INVENTION

Figure 1:
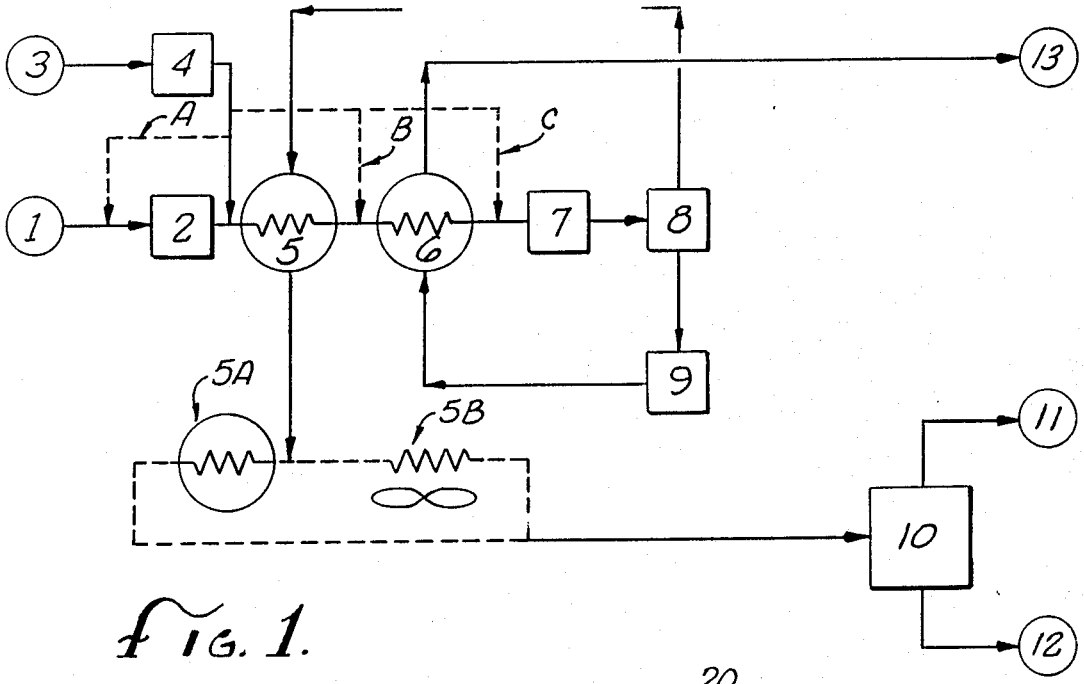
FIG. 1 is a process flow diagram according to one embodiment of the present invention.

The following description is made for the purpose of explaining the general principles of the present invention and is not to be taken in a limiting sense. Therefore, the scope of the present invention should not be limited by the foregoing discussion but should instead be defined by the appended claims and equivalents thereof.

In processing heavy oil according to the present invention, several steps are involved, some of which (as indicated below) are essential to the present invention as described hereinbelow. The others are not essential to capture the heart of the present invention.

Step 1. The heavy oil feedstock is first heated in a vessel to a temperature at which its kinematic viscosity ranges between 150 and 200 centistokes. This temperature will typically range from 150° F. to 200° F.

Step 2. The next step involves removing entrained and dissolved gases from the heavy oil feedstock at temperatures ranging from 150° F. to 200° F. Typically this involves opening a valve of the vessel where the previously discussed heating Step 1 occurs.

Step 3. Next, free water (if any) is removed as either a discrete phase or as a brine emulsion from the feedstock at pressures consistent with heating temperatures of 150° F. to 200° F. It should be appreciated that the gas removal and free water removal steps may be performed in one vessel specifically designed for these steps.

Step 4. An essential step of the present invention is forming a mixture of the heavy oil feedstock with one or more organic reagents having a terminal hydroxyl group. The reagent(s) are preferably dispersed thoroughly throughout the heavy oil feedstock. Such mixing may be accomplished by either static or dynamic mixing devices (or both), or other means, depending upon the viscosity of the feedstock and diffusivity of the reagent(s). The difference in specific gravity between the reagent(s) and the heavy oil feedstock may also influence the choice of mixing mechanisms.

The reagent(s) preferably have a normal boiling point less than the initial boiling point of the heavy oil feedstock at atmospheric pressure. The reagent(s) should preferably be organic, and may have either a complete or an incomplete ether ring. At a minimum, it is essential that the reagent(s) possess a terminal hydroxyl group. Examples of reagents include without limitation 2-methoxy-ethanol, 2-ethoxy-ethanol, 2-isopropoxy-ethanol, isobutoxy-ethanol, tetrahydro-2-furanmethanol, 1,2-ethanediol; alcohols including without limitation benzyl alcohol, cyclohexanol, furfural alcohol, heptanol, hexanol, octanol, 2,5,tetrahydrofurandimethanol, and tetrahydropyran-2-methanol; carbitols including without limitation butyl carbitol, ethyl carbitol, methyl carbitol; cellosolves including without limitation butyl cellosolve and propyl cellosolve and glycols without limitation diethylene glycol, hexylene glycol, propylene glycol, and trimethylene glycol, and pyrocatechol. Preferably, 2-methoxy-ethanol, 2-ethoxy-ethanol, 2-isopropoxy-ethanol, isobutoxy-ethanol, tetrahydro-2-furanmethanol, and 1,2-ethanediol are used as reagent(s).

The amount of the reagent(s) in the mixture should be at least 0.1% by weight of the heavy oil feedstock, preferably from 0.1 to 2.0% by weight of the feedstock, and even more preferably from 0.6 to 1.0% by weight of the heavy oil feedstock.

Step 5. After or simultaneously with forming the heavy oil feedstock/reagent(s) mixture, the other essential feature of the process of the present invention involves heating the resulting mixture from 300° F. to 750° F. in a reactor vessel while simultaneously exposing the mixture to a ferrous metal. The metallic exposure can occur by a variety of methods including without limitation heating the mixture in a metallic reactor vessel having inner walls containing ferrous metal, or adding ferrous metal particles to the mixture, or placing ferrous or steel rods in the reactor vessel, for example. It should be appreciated that use of ferrous metal particles may affect subsequent refining steps.

Preferably, although not essentially, the dimensions of the reactor vessel must be such that, with due consideration of the vaporization of light hydrocarbons (either native to the feedstock or resulting from the interaction of the feedstock, reagent(s), and the reactor vessel walls), a residence time (sometimes referred to as "space time" in a continuous process) of between 600 and 6000 seconds results.

Preferably, although not essentially, the heat flux through the walls of the reactor vessel should be less than 20,000 BTU/hr/sq.ft., and preferably no less than 9,000 nor more than 20,000 BTU/hr/sq.ft. Heat flux values less than the preferred lower limit may result in the formation of unsaturated hydrocarbons, while those greater than the preferred maximum may lead to some thermal decomposition of the hydrocarbon feedstock.

In this regard, it is preferred that the temperature of the hydrocarbon film at the juncture of the reactor vessel inner wall be less than 750° F. to avoid thermal decomposition of the hydrocarbon feedstock.

The dimensions of the reactor vessel should preferably, although not essentially, be chosen such that the multi-phase mixture resulting from heating is never in the spray or dispersed flow region if the inner vessel wall is at a temperature greater than or equal to 750° F. The spray or dispersed flow region is normally defined as one in which nearly all the liquid is in the form of droplets entrained by gases which are flowing through the heating reactor vessel chamber. See *Chemical Engineers' Handbook*, 5th Ed. 1973) at pages 5–40 to 5–41 for a further discussion of the "spray or dispersed flow region."

In order to maintain the maximum contact time between the reagent(s), feedstock and reactor vessel walls, a throttling device at the outlet of the reactor vessel may be desirable to prevent the more volatile reagent(s) from bypassing the liquid wall interface. The throttling device may also be used to accommodate off-designed conditions, for example, the necessity to process a smaller than designed flow rate. The device may include a valve specifically designed for multi-phase flow with an actuator controlled by a mechanism which measures the pressure at the outlet of the reactor vessel and which signals the valve actuator to take corrective action so as to maintain the pressure at the desired value. Such servo mechanisms are in common practice in many chemical and oil processing plants.

The reactor vessel should be constructed of ferrous alloys suitable for the temperatures (and associated pressures) described above. The ferrous alloys may be any of those normally employed in the design of direct-fired heating equipment (containing, for example, molybdenum), or may be of so-called "stainless steel", with nickel and chromium as alloying elements.

The ferrous alloys used may come from the following groups:

I. Carbon steel, where ASTM means American Society for Testing Materials

| |
|---|
| ASTM A-105 |
| ASTM A-106, Grade A or B |
| ASTM A-179 |
| ASTM A-182 |

II. Stainless steel, where AISI means American Iron and Steel Institute

| |
|---|
| AISI Type 304 |
| AISI Type 304L |
| AISI Type 316 |

-continued

| |
|---|
| AISI Type 316L |

III. Alloys for steels for heat-resistant tubulars. The following can be used in forming the tubular reactor vessel. They contain varying amounts of carbon, manganese, silicon, chromium, molybdenum, titanium, and a limited amount of phosphorus. (The numbers refer to the approximate percentage (by weight) of the noted element).

| | | |
|---|---|---|
| ½ Mo | 2¼ Cr—1 Mo | 7 Cr—½ Mo |
| ½ Cr—½ Mo | 3 Cr—1 Mo | 9 Cr—1 Mo |
| 1 Cr—½ Mo | 5 Cr—½ Mo | |
| 1¼ Cr—½ Mo | 5 Cr—½ Mo—Si | |
| 2 Cr—½ Mo | 5 Cr—½ Mo—Ti | |

The details of the reactor vessel design may vary with size, but the basic criterion of strength at elevated temperatures for extended periods of time must be met in accordance with sound engineering practice, as set forth in API (American Petroleum Institute) Standard 560, "Fired Heaters for General Refinery Services", 1986. It should also be appreciated that the multiple constraints on a coiled reactor vessel may result in the variation of diameter and metallurgy throughout the length of the tubular reactor vessel.

Step 6. After heating in the reactor vessel as discussed above, other steps are performed. Typically, a phase separation (vapor v. liquid) is performed, preferably in a separation chamber, of suitable dimensions for the flow rate, in flow communication with the reactor vessel. The components of the effluent from the reactor vessel which are liquid at the pressure and temperature in the separation chamber can be directed into a different flow path from the components which are either gaseous or vapor phase.

The phase separation of the effluent from the reactor vessel may be performed either in a gravity chamber or in a cyclonic chamber either of which may or may not have a mist eliminator. The design particle size for this chamber is preferably 100 microns. In general, the specific gravity of the liquid particles will be approximately 0.7. The gas density will vary with downstream processing requirements but will likely be on the order of 0.4 referred to air at standard conditions (60° F. and 14.7 psi).

Step 7. Next, heat can be exchanged between the gaseous and vapor phase stream from the phase separation Step 6, and the reagent(s) feedstock mixture of Step 4, so as to cool the gaseous and vapor phase stream, and heat the mixture of feedstock and reagent(s).

Step 8. Next, heat can be exchanged between the liquid effluent from the phase separation Step 6, and the heated feedstock-reagent(s) mixture effluent from the previous Step 7, thus heating still further the feedstock reagent(s) mixture prior to introducing it into the reactor vessel, while cooling the liquid effluent from phase separation Step 6 to a temperature more suitable for further Step 6 storage or transportation.

Step 9. With respect to the cooled gas-vapor mixture resulting from the first heat exchange Step 6, a phase separation can be performed and the gas effluent dehydrated by any means (for example, liquid or solid absorption), and further removing any acid gases by techniques such as amine absorption. The liquid portion resulting from this phase separation can be combined with the liquid portion resulting from heat exchange Step 8, and further processed as is known in the art to separate the various hydrocarbon components. A portion of the methane-ethane mixture resulting from Step 9 may be utilized as a fuel for the process.

Step 10. Finally, a separation step, either by refrigeration or absorption techniques well know in the art, can be performed to separate methane and ethane from the propane, butanes, and pentanes which may be in the effluent from the acid removal Step 9.

After all of these Steps 1–10 are performed, the various categories of hydrocarbon-gases (methane and ethane), so-called "liquid petroleum gases" (propane, iso- and normal butane); and the hydrocarbons normally liquid at temperatures of approximately 100° F., may be combined or separated in the normal fashion, bearing in mind that the liquid from Step 8 above is preferably cooled to a temperature consistent with the atmospheric vapor pressures of the liquid portions of the effluent from Step 9 above.

The present invention is illustrated, but not limited by, the following test examples in 1–11 where, unless otherwise indicated, the quantities are in (a) parts by weight, (b) specific gravities are expressed as a ratio of the weight of liquid to that of the weight of the same volume of water, both at 60° F., and (c) viscosities are expressed in centipoises at 122° F.

TABLE I

| Test Conditions | | | | | | | | | Resulting Hydrocarbons | | | | | |
|---|---|---|---|---|---|---|---|---|---|---|---|---|---|---|
| | | | | | | | | | Liquid | | | Gases | | |
| Test | Charge Grams | Reagent Code[1] | Weight (Grams) | Reactor Vessel Volume[2] (cu cm) | Initial Pressure (Atm) | Watts per Gram | Time[3] Mins | Maximum Temp (°F.) | Specific Gravity | Centi-poise | Weight (Grams) | Volume (cu cm) | Specific Gravity | BTU/ cu ft |
| 1 | 257 | A | 1.10 | 940 | 0.2 | 2.03 | 35 | 670 | 0.930 | 10 | 222 | 59000 | 0.016 | 1487 |
| | | D | 0.90 | | | | | | | | | | | |
| 2 | 260 | A | 0.96 | 940 | 0.2 | 2.00 | 10 | 380 | 0.917 | 27 | 212 | | | |
| | | D | 1.02 | | | | | | | | | | | |
| 3 | 305 | A | 0.96 | 675 | 1 | 1.38 | 38 | 700 | 0.967 | 201 | 261 | | | |
| | | D | 1.44 | | | | | | | | | | | |
| 4 | 254 | E | 2.00 | 940 | 0.2 | 2.04 | 83 | 700 | 0.907 | 11 | 160 | | | |
| 5 | 265 | A | 1.20 | 675 | 0.2 | 1.95 | 30 | 538 | 0.922 | 12 | 229 | | | |
| | | D | 1.10 | | | | | | | | | | | |
| | | F | 1.30 | | | | | | | | | | | |
| 6 | 254 | F | 2.42 | 940 | 0.2 | 2.05 | 50 | 650 | 0.937 | 38 | 232 | 213000 | 0.943 | 1394 |
| 7 | 336 | A | 0.96 | 675 | 0.2 | 1.55 | 50 | 500 | 0.961 | 220 | 322 | | | |
| | | B | 0.93 | | | | | | | | | | | |
| 8 | 257 | A | 1.10 | 940 | 2.02 | 2.02 | 90 | 582 | 0.933 | 26 | 229 | | | |
| | | D | 1.20 | | (2) | | | | | | | | | |

[1]Reagent Codes: A 2-methoxy-ethanol; B 2-ethoxy-ethanol; C 2-isopropoxy-ethanol; D isobutoxy-ethanol; E Tetrahydro-2-furanmethanol; F 1,2-Ethanediol

[2]At ambient temperature of 75–85° F.

[3]Interval of time between when the temperature of the mixture in the reactor vessel is at the normal (atmospheric) reagent boiling temperature and when the temperature of the mixture in the reactor vessel is at its maximum.

TABLE II

| Test Conditions | | | | | | | | | Resulting Hydrocarbons | | | | |
|---|---|---|---|---|---|---|---|---|---|---|---|---|---|
| | | | | | | | | | Liquid | | Gases | | |
| Test | Charge Grams | Reagent Code | Weight (Grams) | Chamber Volume (cu cm) | Initial Pressure (Atm) | Watts per Gram | Time[3] Mins | Maximum Temp (°F.) | Specific Gravity | Weight (Grams) | Volume (cu cm) | Specific Gravity | BTU/cu ft |
| 9 | 285 | 2-methoxy-ethanol | 0.96 | 660 | 1 | 1.84 | 85 | 540 | 0.984 | | 85600 | 0.965 | 1174 |

TABLE III

| Test 10 | | | | | |
|---|---|---|---|---|---|
| Feed rate (cc/min) | | | | 142 | |
| Heater (for coil) input (kilowatts) | | | | 2.4 | |
| Maximum temperature (°F.) | | | | 350 | |
| Specific gravity | | | | 0.935 | |
| Viscosity (centipoise at 122° F.) | | | | 34 | |
| Test 11 | A[2] | B[2] | C[2] | D[2] | E[2] |
| Feed rate (cc/min) | 170 | 216 | 160 | 97 | 270 |
| Heater input (Kilowatts) | 4.2 | 3.6 | 2.7 | 2.1 | 3.9 |
| Maximum temperature (°F.) | 620 | 550 | 565 | 555 | 540 |
| Olefins in resulting hydrocarbons (volume percent) | [1] | 2.9 | 2.6 | 1.8 | [1] |

[1]Not detectable by ASTM D1319 test procedure.
[2]Periods of time within duration of Test 11.

TABLE IV

| | Initial Boiling Point | Distillate volume % 5 | 10 | 20 | 30 | 40 | Cracking[1] | |
|---|---|---|---|---|---|---|---|---|
| Kern River Crude | | | | | | | | |
| Before Treatment | 522 | 674 | 731 | 817 | 902 | 971 | 1014 (56%) | |
| After Test 1 | 145 | 239 | 290 | 360 | 430 | 490 | 760 | |
| After Test 6 | 200 | 280 | 335 | 410 | 490 | 550 | 700 | Vapor |
| After Test 10 | 488 | 562 | 592 | 645 | 706 | 769 | 1045 (70%) | Temperature |
| Vacca Tar Sands | | | | | | | | |
| Before Treatment | 340 | 540 | | | | | | |
| After Test 9 | 150 | 287 | 337 | 425 | 500 | 580 | 914 (87%) | |

[1]Volume % at which cracking occurs.

Figure 2:
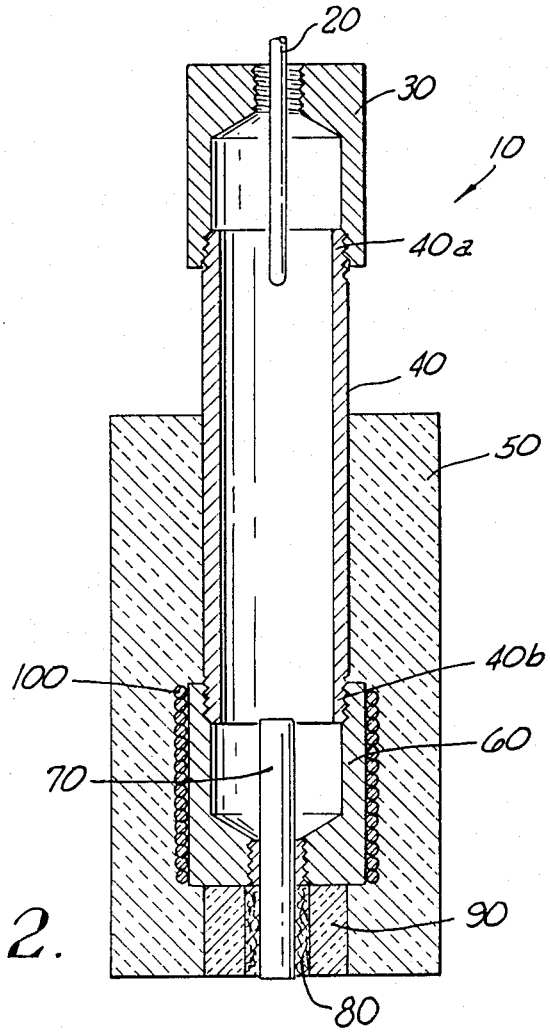
FIG. 2 is a cross-sectional view of an autoclave reactor vessel.

In test examples 1–8, shown in Table I, unless otherwise noted, Kern River crude oil, with a specific gravity of 0.969 and a kinematic viscosity of 565 centistokes at 122°F was heated in an autoclave reactor vessel of the type shown in FIG. 2 with the indicated varying reagents and concentrations. In addition, the volume of the reactor vessel was varied, as was the heat input, and the initial conditions. Various parameters were measured on the effluents from the autoclave after heating; these are noted in the table.

In test 9 described in Table II, Vacca tar sand hydrocarbons, with a specific gravity of 1.047, and a pour point in excess of 160° F., were treated in a similar fashion to tests 1 through 8, with the specified noted results. The effluent liquid at 85° F. had a viscosity of 75 centistokes.

Figure 3:
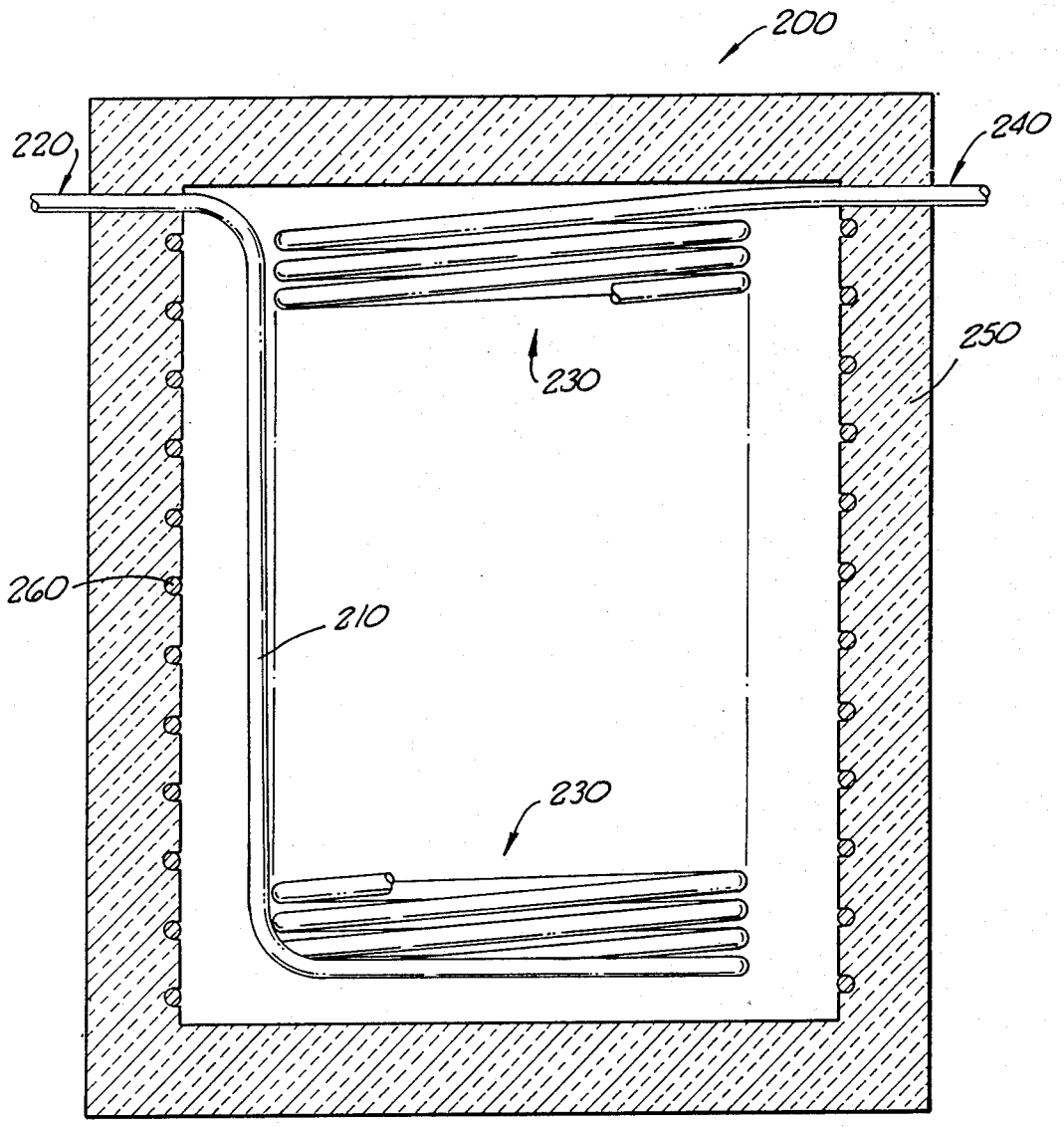
FIG. 3 is a cross-sectional view of a tubular reactor vessel in a heating chamber.

In tests 10 and 11 described in Table III, Kern River crude oil was processed in a continuous processing plant using a coiled tubular reactor vessel and included Steps 1, 2, and 4 through 6 described above. FIG. 3 shows a typical coiled reactor vessel. The vapors and liquid from the phase separation (Step 6) were cooled before re-combining. In the test, one percent (1%) (by weight) of tetrahydro-2-furan-methanol was added to the heavy oil feedstock (Step 4).

In addition to the above-cited results shown in Tables I–III, distillation curves were obtained for certain test examples. The results are presented in Table IV.

The general direction of flow in a continuous reactor vessel must be upward (although there may be horizontal or near-horizontal segments). This is because of (a) the unsteady nature of multi-phase flow, and (b) the bouyancy provided by the gases in multi-phase flow. This buoyancy is a stabilizing influence on the multi-phase flow in the reactor vessel.

As noted above, FIG. 2 shows an autoclave reactor vessel 10, which was used for tests 1 through 9 and Tables I and II. Temperature measuring probe 20 is mounted in threaded reducer 30. Threaded reducer 30 is attached to one end 40*a* of threaded pipe 40, which is surrounded by glass fiber insulation 50. The other end 40*b* of threaded pipe 40 is connected to threaded reducer 60. Within threaded reducer 60 is connected electric cartridge heater insertion 70 which is, for example, 125 watts. One end of the heater 70 is sealed by sealing gland 80, and ceramic wool insulation 90 is placed therearound. Surrounding threaded reducer is flexible electrical heaters 100, for example, 3 at 100 watts or 4 at 100 watts.

As noted above, FIG. 3 shows a coiled reactor vessel 200 having a design flow of two barrels per day. Metallic heating chamber 210 is shown having warm liquid inlet 220 through coils (0.5 inch O.D. and 0.37 inch I.D.) 230 (supports not shown) and hot multi-phase outlet 240. The coil (12 inch diameter) is placed within ceramic insulation 250, having embedded therein electrical heating elements 260.

The inventors have postulated a probable mechanism for the present invention involving an ionic iron complex, i.e., Fe(II) or Fe(III). The restructuring of the hydrocarbons apparently involves a surface reaction among the reagent(s), the ferrous metal and the heavier hydrocarbons (so-called polysegmented hydrocarbons).

Flow diagram FIG. 1 is a convenient description of one embodiment of the present invention. There it is shown that heavy oil feedstock 1 is pumped by feed-pump 2, past overhead condenser 5 and liquid cooler 6, into reactor vessel 7. Reagent stream 3 is pumped by reagent pump 4 into the feedstock stream. After heating in reactor vessel 7, the mixture flows to phase separator vessel 8. After phase separation, liquids are pumped via liquid pump 9 past liquid cooler 6 (heat exchange) into cooled heavier liquid stream 13. Vapors from the phase separation flow past overhead condenser 5 (heat exchange) to overhead phase separator vessel 10. After phase separation, the light hydrocarbons are streamed to vessel 12 and the non-condensable gases are streamed to vessel 11 or to the atmosphere.

It should be appreciated that the heat exchangers (items 5 and 6 in FIG. 1) are shown as "shell and tube" exchangers, a type of heat exchanger in which the two fluids are separated by walls of thin, circular tubes. In general, the cooler liquid is passed through the tubes, the hotter liquid through the surrounding shell, which may be of pipe or plate rolled into a tubular shape. There are other suitable types, such as the double pipe exchanger. These, and other suitable types, are described in section 11 of the *Chemical Engineers Handbook*, 5th ed., McGraw Hill Book Company, particularly pages 11–3 to 11–5 (1973).

Items 5A and 5B are alternate ways of further cooling the overhead gases and vapors. They may be either of the types mentioned previously, in which case water would be used as the cooling medium. They could also be of the air-cooled heat exchanger type; similar to an automotive radiator, in which air, either pulled or pushed over externally-thinned tubes by a fan or propeller, serves as the cooling medium. They are also described in the *Chemical Engineers Handbook* previously noted.

Dotted line paths A, B and C show alternative pathways for reagent stream 3, depending upon the temperature-viscosity relationship of the heavy feedstock.

In summary the present invention can be described as a process of improving the characteristics of heavy oil by adding a reagent having a terminal hydroxyl group to the feedstock, and heating the feedstock in a reactor vessel between 300° and 750° F. while simultaneously exposing the mixture to a ferrous metal.

We claim:

1. A process for reducing the specific gravity and viscosity of heavy oil having an API gravity of 20° or less and a gas-free viscosity of 100 centipoises or more, the process including the following steps:

forming a mixture of the heavy oil and one or more organic reagents having a terminal hydroxyl group; and heating the mixture from 300° to 750° F. in a reactor vessel while simultaneously exposing the mixture to a ferrous metal.

2. A process for reducing the specific gravity and viscosity of heavy oil according to claim 1 wherein the organic reagent is selected from the group consisting of 2-methoxy-ethanol, 2-ethoxy-ethanol, 2-isopropoxy-ethanol, isobutoxy-ethanol, tetrahydro-2-furan-methanol, 1,2-ethanediol, and mixtures thereof.

3. A process for reducing the specific gravity and viscosity of heavy oil according to claim 1 wherein the normal boiling point of each of the organic reagents is less than the normal boiling point of the heavy oil.

4. A process for reducing the specific gravity and viscosity of heavy oil according to claim 2 wherein the reagent is 1,2-ethanediol.

5. A process for reducing the specific gravity and viscosity of heavy oil according to claim 1 wherein the amount of the reagent in the mixture is at least 0.1 percent by weight of the heavy oil.

6. A process for reducing the specific gravity and viscosity of heavy oil according to claim 5 wherein the amount of the reagent in the mixture ranges from 0.1 to 2 percent by weight of the heavy oil.

7. A process for reducing the specific gravity and viscosity of heavy oil according to the claim 6 wherein the amount of the reagent in the mixture ranges from 0.6 to 1 percent by weight of the heavy oil.

8. A process for reducing the specific gravity and viscosity of heavy oil according to claim 1 wherein the residence time in the reactor vessel ranges from 600 to 6000 seconds.

9. A process for reducing the specific gravity and viscosity of heavy oil according to claim 1 wherein the heat flux through the reactor vessel is less than 20,000 BTU/hr/sq.ft.

10. A process for reducing the specific gravity and viscosity of heavy oil according to claim 1 wherein the heated mixture is never in the spray flow region of the multi-phase flow of the heated mixture when the inner wall of the vessel is at a temperature greater than 750° F.

11. A process for reducing the specific gravity and viscosity of heavy oil according to claim 1 wherein the inner wall of the reactor vessel consists of ferrous metal.

12. A process for reducing the specific gravity and viscosity of heavy oil according to claim 1 wherein the reactor vessel is a stainless steel tube.

13. A process for reducing the specific gravity and viscosity of heavy oil reducing to claim 1 wherein the reagent and ferrous metal are chosen such that at the heating temperature, an ionic iron complex is formed with the terminal hydroxyl group of the organic reagents.

14. A process for reducing the specific gravity and viscosity of heavy oil according to claim 1 wherein the organic reagent is chosen from the group consisting of 2-methoxy-ethanol, 2-ethoxy-ethanol, 2-isopropoxy-ethanol, isobutyoxy-ethanol, tetrahydro-2-furan-methanol, 1,2-ethanediol, benzyl alcohol, cyclohexanol, furfural alcohol, heptanol, hexanol, octanol, 2,5, tetrahydrofuran-dimethanol, tetrahydropyran-2-methanol, butyl carbitol, ethyl cellosolve; methyl cellosolve butyl cellosolve, propyl cellosolve, diethylene glycol, hexylene glycol, propylene glycol, trimethylene glycol, pyrocatechol, and mixtures thereof.

15. A process for reducing the specific gravity and viscosity of heavy oil according to claim 9 wherein the heat flux through the reactor vessel ranges from 9,000 BTU/hr/sq.ft. to 20,000 BTU/hr/sq.ft.

16. A process for reducing the specific gravity and viscosity of heavy oil according to claim 1 wherein the amount of reagent in the mixture ranges from 0.1 to 3% by weight of the heavy oil.

17. A process for increasing the volume of light hydrocarbons distilled from a heavy oil feedstock having an API gravity of 20° or less than a gas-free viscosity of 100 centipoises or more at a selected temperature, the process including the following steps:

(1) mixing the heavy oil feedstock with one or more organic reagents having a terminal hydroxyl group;

(2) heating the mixture resulting from step (1) from 300° F. to 750° F. and simultaneously exposing the mixture to a ferrous metal;

(3) separating the vapor and liquid phases resulting from step (2); and (4) separating the hydrocarbons resulting from step (3).

18. A process for increasing the volume of light hydrocarbons distilled from a heavy oil feedstock at a given selected temperature according to claim 17 wherein the heavy oil feedstock is initially heated to a temperature ranging from 150° to 200° F.

19. A process for increasing the volume of light hydrocarbons distilled from a heavy oil feedstock at a selected temperature according to claim 17 wherein the organic reagent is selected from the group consisting of 2-methoxy-ethanol, 2-ethoxy-ethanol, 2-isopropoxy-ethanol, isobutoxy-ethanol, tetrahydro-2-furan-methanol, 1,2-ethanediol, and mixtures thereof.

20. A process for increasing the volume of light hydrocarbons distilled from a heavy oil feedstock at a selected temperature according to claim 17 wherein the amount of the reagent in the mixture is at least 0.1 percent by weight of the heavy oil feedstock.

21. A process for increasing the volume of light hydrocarbons distilled from a heavy oil feedstock at a selected temperature according to claim 17 wherein the amount of the reagent in the mixture ranges from 0.1 to 2 percent by weight of the heavy oil feedstock.

22. A process for increasing the volume of light hydrocarbons distilled from a heavy oil feedstock at a selected temperature according to claim 17 wherein the heating occurs in a reactor vessel and wherein the residence time in the reactor vessel ranges from 600 to 6000 seconds.

23. A process for increasing the volume of light hydrocarbons distilled from a heavy oil feedstock at a selected temperature according to claim 17 wherein heat flux through the reactor vessel is less than 20,000 BTU/hr/sq.ft.

24. A process for increasing the volume of light hydrocarbons distilled from a heavy oil feedstock at a selected temperature according to claim 17 wherein the heated mixture is never in the spray flow region of the multi-phase flow of the heated mixture when the inner wall of the vessel is at a temperature greater than 750° F.

25. A process for increasing the volume of light hydrocarbons distilled from a heavy oil feedstock at a selected temperature according to claim 17 wherein the inner wall of the reactor vessel consists of ferrous metal.

26. A process for increasing the volume of light hydrocarbons distilled from a heavy oil feedstock at a selected temperature according to claim 17 wherein the reactor vessel is a stainless steel tube.

27. A process for increasing the volume of light hydrocarbons distilled from a heavy oil feedstock at a selected temperature according to claim 20 wherein the heat flux through the reactor vessel ranges from 9,000 BTU/hr/sq.ft. to 20,000 BTU/hr/sq.ft.

28. In a process for reducing the specific gravity and viscosity of heavy oil wherein the heavy oil flows through a tubular reactor vessel having inner walls which comprise ferrous metal, the improvement wherein the inner diameter and length of the vessel are chosen such that the flow rate of the heavy oil through the tubular vessel results in a residence time within the tubular vessel ranging from 600 to 6,000 seconds, the heat flux through the walls of the tubular vessel ranges from 9,000 Btu/hr/sq.ft. to 20,000 Btu/hr/sq.ft., and wherein the heavy oil flowing through the tubular vessel is never in the spray flow region of the multi-phase flow of the heavy oil when the inner wall of the vessel is at temperature greater than 750° F., and wherein the heavy oil flowing through the tubular vessel includes one or more organic reagents having a terminal hydroxyl group.

* * * * *